US005313989A

United States Patent [19]

Fröhlich

[11] Patent Number: 5,313,989

[45] Date of Patent: * May 24, 1994

[54] SLIDE FASTENER WITH CONTINUOUS COUPLING COIL WOVEN INTO THE SUPPORT TAPE

[75] Inventor: Alfons Fröhlich, Essen, Fed. Rep. of Germany

[73] Assignee: Opti Patent-, Forschungs- und Fabrikations-AG, Allmeind, Switzerland

[ * ] Notice: The portion of the term of this patent subsequent to Oct. 12, 2010 has been disclaimed.

[21] Appl. No.: 21,243

[22] Filed: Feb. 23, 1993

Related U.S. Application Data

[62] Division of Ser. No. 894,707, Jun. 5, 1992, Pat. No. 5,251,675.

[30] Foreign Application Priority Data

Jun. 18, 1991 [DE] Fed. Rep. of Germany ..... 4120030

[51] Int. Cl.[5] ..... D03D 13/00

[52] U.S. Cl. ..... 139/384 B; 24/392

[58] Field of Search ..... 139/384 B; 24/392

[56] References Cited

U.S. PATENT DOCUMENTS 3,885,276 5/1975 Moertel ..... 139/384 B X
4,188,982 2/1980 Yoshida et al. ..... 139/384 B
4,191,220 3/1980 Yoshida ..... 139/384 B
4,254,803 3/1981 Tsubata ..... 139/384 B
4,623,004 11/1986 Matsushima et al. ..... 139/384 B

FOREIGN PATENT DOCUMENTS 3007276 12/1982 Fed. Rep. of Germany ... 139/384 B
3022032 2/1983 Fed. Rep. of Germany ... 139/384 B
2855370 11/1983 Fed. Rep. of Germany ... 139/384 B

*Primary Examiner*—Andrew M. Falik
*Attorney, Agent, or Firm*—Herbert Dubno

[57] ABSTRACT

In a slide fastener in which the row of coupling elements is woven into the tape, the warp yarns are formed in part with binding warp yarns in two or three groups. The warp yarns of the first group pass under double weft insertions between coupling members then over two or three coupling members and then under a coupling member and a double weft of the ground weft yarn underlying same. The binding warp yarns of the second group or arrangement pass over the double wefts between the coupling members and then under the coupling members and the double weft underlying same. A third group or arrangement can also be provided in which the double weft between the coupling members is lifted thereby into a loop and the coupling members are overshot by the binding warp of the third group.

5 Claims, 4 Drawing Sheets

SLIDE FASTENER WITH CONTINUOUS COUPLING COIL WOVEN INTO THE SUPPORT TAPE

CROSS REFERENCE TO RELATED APPLICATION

This application is a continuation of Ser. No. 07/894,707, U.S. Pat. No. 5,251,675.

FIELD OF THE INVENTION

My present invention relates to a slide fastener having the woven support tape and a continuous monofilament coupling element woven into the support tape.

BACKGROUND OF THE INVENTION

It is known in the art to provide a slide fastener in which the two slide-fastener halves for the coupling heads of the coupling elements formed by continuous monofilament coupling coils, are woven into the support tapes which themselves are woven. There are certain structures which characterize this class of slide fasteners. For example, the coupling heads may be formed by bends of the coupling coils, the shanks extending rearwardly from the heads may be superimposed in projection on the slide-fastener plane, the shanks can be formed as double wefts and the tape can be formed from double wefts formed by a continuous weft filament or yarn providing the ground weft, and warp yarns can be interwoven with the double wefts and can form binding warp yarns retaining the coupling weft or coil on the tape.

The German Patents 30 09 276 and 30 22 032 describe such systems; various configurations of the binding warp yarns and different ratios of the warp insertion to the length of the slide fastener are used, but the arrangement is always such that two coupling elements are contained in a warp yarn pocket.

This system has been found to be effective, but the stiffness with respect to bending in the slide-fastener plane and out of the slide-fastener plane can be improved upon. Also the connection between the coupling coil and the web, its resistance to deterioration in use and the like can be improved upon.

In DE 28 55 370, a different type of slide-fastener stringer is described, in which the binding warp yarns may have a similar pattern to those of the instant invention but it will be recognized that the binding warp yarns of the first groups here do not, following the overshoot of the coupling elements, engage below the next double weft of the ground weft yarn. In addition, the coupling elements are not formed as synthetic resin monofilament double-weft insertions and thus cannot be fabricated by a weaving process involving one or two weft insertion needles as can be the stringer of the invention. The coupling element must be formed in this earlier system by a machine which is alien to the tape fabrication machines utilizing such insertion needles, namely, with the aid of a coiling machine having a coiling mandrel so that the coils can be woven into the tape only within the weaving shed.

These systems are more expensive and have low productivity and the nature of the binding of the coupling coil in place does not enhance bendability. Indeed, the bending characteristics are determined by the presence of a filler yarn. The resistance to raveling and change of shape at the junction between the coil and the tape is not equivalent to that which can be obtained with the present invention however. The double wefts of the ground weft yarns pass over the connecting bights of the coupling elements, come into contact with the flanks of the slider and are relatively rapidly deteriorated.

OBJECTS OF THE INVENTION

It is, therefore, the principal object of the present invention to provide an improved slide fastener, stringer or slide-fastener half which avoids the aforementioned drawbacks and, in general, represents an improvement over prior systems.

Another object of the invention is to provide an improved slide-fastener half which has better bending characteristics than earlier systems and does not suffer from deterioration at the connection between the coupling coil and the tape as may be the case in earlier systems and, further, does not suffer change in shape or bulging at the connection between the coil and the tape.

Still another object of the invention is to improve the characteristics of a slide fastener even under circumstances where the tapes may be stretched to articles and the two halves are drawn into the slider to a certain extent, and to provide slide-fastener halves for improved coupling action even with limited engagement in one another.

It is still another object of the invention to improve the structural, bending and wear characteristics of a slide fastener without detrimental effect on the transverse strength and resistance to buckling thereof.

SUMMARY OF THE INVENTION

These objects are attained, in accordance with the invention, by the combination of the following features:

(a) A first binding warp yarn arrangement or group with a plurality of binding warp yarns is so interwoven with the ground weft and the double wefts formed by the coupling row that these binding warp yarns always pass or undershoot the double wefts of the ground weft, pass over two coupling elements and thereafter undershoot or underpass a coupling element and the double weft of the ground weft underlying same; and (b) A second binding warp yarn arrangement is provided with at least one binding warp yarn which overshoots the double weft of the ground weft between the coupling members and undershoots the coupling elements with the double weft of the ground weft underlying same.

Also vital for the invention is that each coupling element underlain by a double weft of the ground weft is underpassed not only by one of the binding warp yarns of the first group but also by a binding warp yarn of the second group.

More particularly, the slide-fastener half of the invention can comprise:

a woven tape having a multiplicity of double wefts interwoven with warps, the double wefts being formed by a continuous weft yarn defining in the tape a ground weft; and a continuous plastic monofilament coupling row woven into the tape along a longitudinal edge thereof, the coupling row being comprised of coupling elements having:

spaced apart coupling heads formed by bends of the plastic monofilament, a pair of shanks extending rearwardly from each of the heads as a monofilament double weft so that projections of each shank on a plane of the tape are substantially superimposed, and respective connecting bights along a rear of the row connecting each of the shanks to a shank of an adjoining coupling element, each of the pair of shanks overlying a double weft of the ground weft, a further double weft of the ground weft being disposed between pairs of shanks of successive coupling elements without passing over the row, the warps in a region of the row including a plurality of binding warp yarns passing in part over the elements, the further double wefts being drawn up from the plane to a region of an upper shank of the respective pair by at least one of the binding warp yarns to form a bracing loop of the weft yarn between the pairs of shanks of the coupling elements, the binding warp yarns including a first group comprised of a plurality of the binding warp yarns so interwoven in the tape as always to pass under double wefts of the ground weft, over at least two coupling elements of the row and then under a pair of shanks and the double weft of the ground weft underlying same, the binding warp yarns including a second group comprised of at least one binding warp yarn in succession, passing over the double wefts of the ground weft between the coupling elements, and under a pair of shanks and the double weft of the ground weft underlying same, and each pair of shanks and an underlying double weft of the ground weft beneath which a binding warp yarn of the first group passes also being underpassed by a binding warp yarn of the second group.

The invention is based upon my discovery that the combination of the features (a) and (b) can successfully improve the bending characteristics of the slide-fastener half without reducing its strength when subjected to transverse forces and without increasing its tendency to buckle, while at the same time preventing deterioration or change in the region of the tape at which the coupling row is affixed thereto.

The individual coupling elements, namely each coupling head and the double-weft insertion formed by the shanks thereof, is received in a binding warp pocket.

The coupling row forms a chain in which the number of chain elements compared to earlier systems having two coupling elements in each warp yarn pocket can be doubled. This reduces the stiffness resisting bending and thus increases the bendability without, however, detrimentally affecting the transverse strength or the resistance to buckling.

I have found that an important parameter in the fabrication of the slide-fastener half of the invention is the binding warp yarn insertion or incorporation ratio, i.e. the ratio of the extended length of the warp yarn which is involved in the binding action to the length of the so-called slide fastener chain. As the binding warp yarn passes with more convolutions up and down through the coupling coil, the insertion ratio increases.

In a preferred embodiment of the invention, the binding warp yarn insertion ratio of the binding warp yarns of the first group lies in the range of 1.25:1 to 1:35:1 and most preferably is 1.28:1 to 1.32:1.

The at least one binding warp yarn of the second binding warp yarn arrangement should have an insertion ratio of 2.50:1 to 3.50:1. Best results are given with an insertion ratio of 2.80:1 to 3.20:1 for the yarn of the second group. The insertion ratios apply to slide fasteners with coupling element rows of monofilament with a thickness of 0.48 to 0.50 mm and hence a coupling element row thickness of 1.1 to 1.4 mm.

With higher monofilament thickness, the absolute insertion values will be higher.

A third feature has also been found to be highly advantageous in the combination, namely:

(c) The binding warp yarns can include a third binding warp yarn group or arrangement with at least one binding warp yarn so introduced that the double wefts of the tape between the coupling elements which are drawn upwardly in the aforementioned ground weft yarn loops are underpassed by the binding warp yarn while the coupling elements are passed over by it, the first and second binding warp yarn arrangements being proximal to the rear or bights of the coupling row while the third group or arrangement of binding warp yarns is proximal to the coupling heads.

The insertion ratio for this third group can be 1.10 to 1.20 and most preferably 1.14 to 1.18.

The first binding warp yarn group can be made up of three or four binding warp yarns. In the first case, they are each offset by two weft insertions from one another and in the second case, the binding warp yarns are offset by two weft insertions.

The first binding warp yarns can be disposed in the pattern high/low/high/low/low/low or in the pattern high/low/high/low/low/low/low/high/low, which patterns repeat when two or three coupling elements are overshot by these binding warp yarns.

The second binding warp yarn arrangement is preferably of the pattern low/high while the binding warp yarns of the third group can have a high/low pattern. The binding warp yarns of the first and/or second and/-third binding warp yarn arrangements can lie adjacent one another on the shanks of the coupling elements in multiples.

The binding warp yarns can include stay threads disposed between the coupling element and the double wefts of the ground weft lying therebeneath. The yarns of the tape may be composed of polyester while the monofilament is composed of polyamide, e.g. polyamide 6,6 or the polyester polybutyleneterephthalate.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
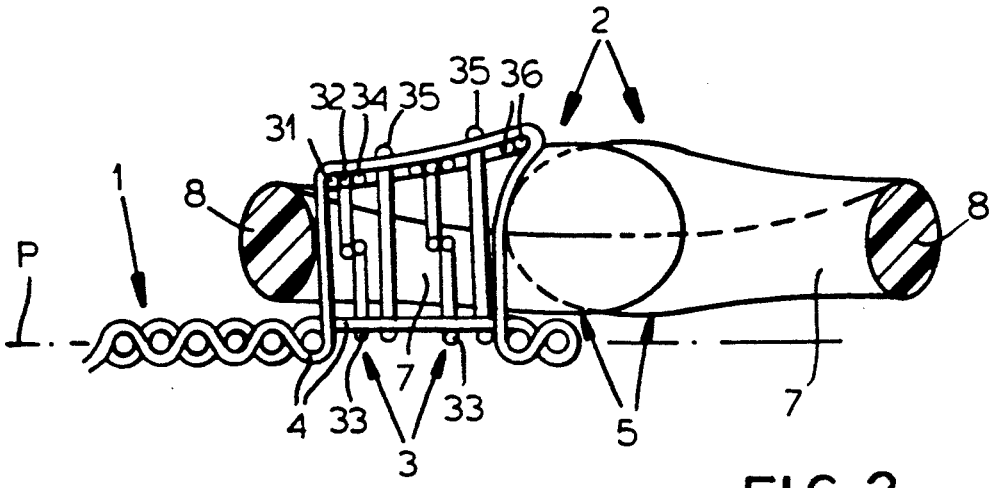
FIG. 2 is a transverse section seen in the direction of the arrow II of FIG. 1 through the slide-fastener stringer thereof.

As can be seen from the drawing, a slide-fastener half, which can form a slide-fastener stringer by interconnection with another slide-fastener half, comprises a woven support tape 1 and a row 2 of coupling elements in the form of a continuous plastic monofilament woven into the tape.

The tape 1 is comprised of warp yarns 3 and inserted double wefts 4 forming part of a continuous weft yarn and forming a ground weft. The plane of the ground weft is represented generally at P in FIG. 2.

The row 2 of coupling elements of which slide-fastener half, is formed also of a continuous monofilament in a coil produced during the weaving process by the insertion into and including coupling elements 5 each of which comprises a coupling head 6 formed by a bend in the monofilament and a pair of shanks 7 extending rearwardly from the head and in superposed relationship so that the projections of the two shanks 7 upon the plane 7 will coincide. The shanks 7 are coupled at the rear of the coupling row by connecting parts or bights 8.

The arrangement is such that the double weft 4 in a projection on the slide-fastener plane P lies below the coupling members 5 and between two coupling members 5 in alternation.

Some of the warp yarns 3 form binding warp yarns which engage the coupling members 5. The double wefts 4 between the coupling members 5 are lifted into ground weft yarn abutment loops to the height of upper shank, such a loop being clearly visible in FIG. 2 and having its vertical strands abutting the head of a coupling row interdigitating with the coupling row under discussion and against the bight 8, respectively. The loop is drawn upwardly by at least some of the binding warp yarns.

Figure 1:
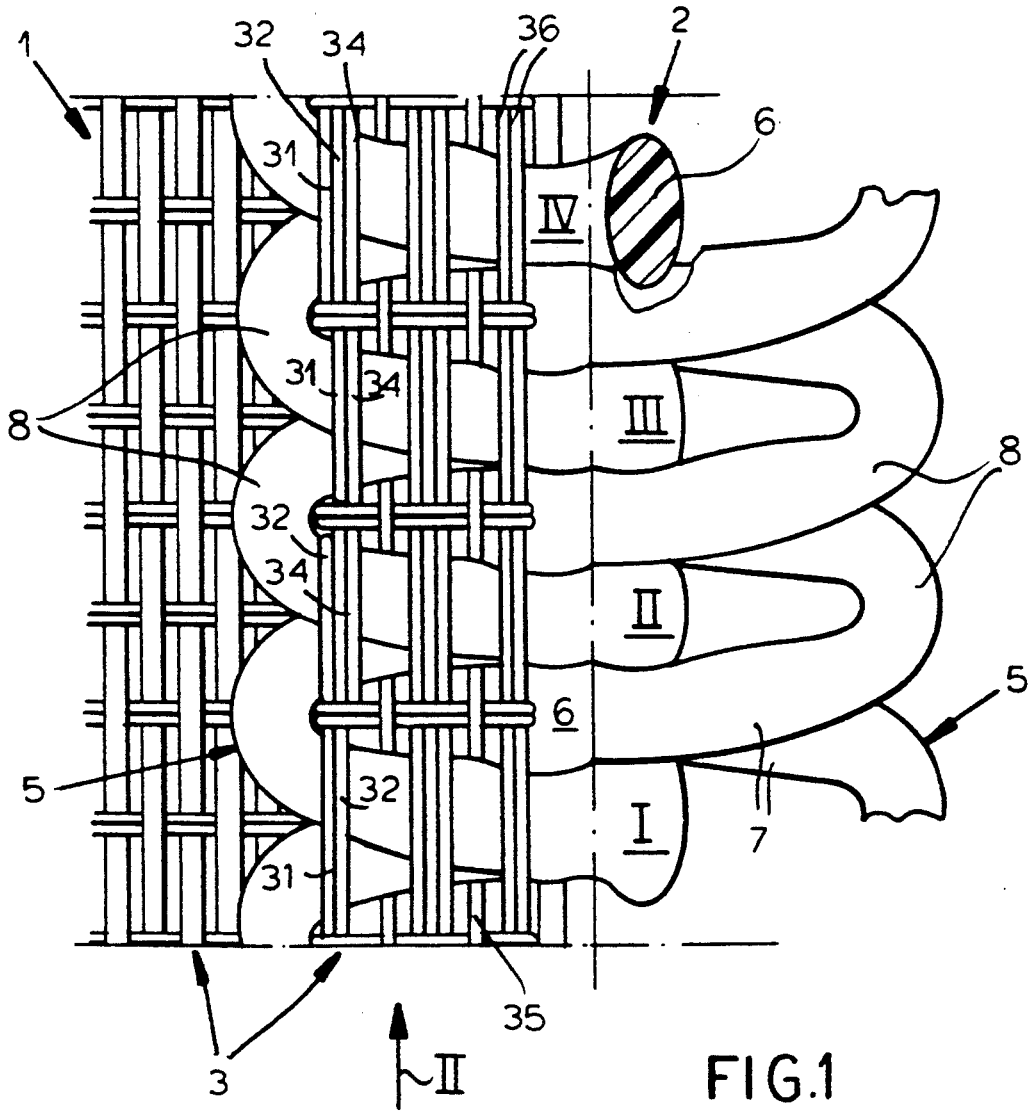
FIG. 1 is a plan view in somewhat diagrammatic form and exaggeratedly large in scale of a slide fastener stringer showing the tape on one slide-fastener half thereof.
Figure 3:
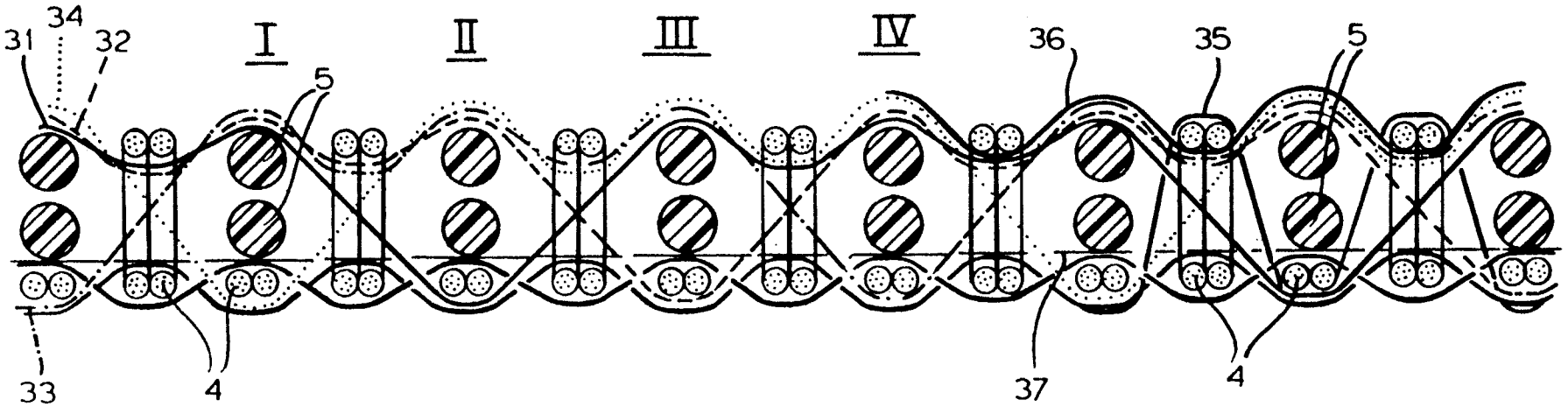
FIG. 3 is a diagram of the binding pattern for the binding warp yarns according to the invention for the embodiment of FIGS. 1 and 2.
Figure 4:
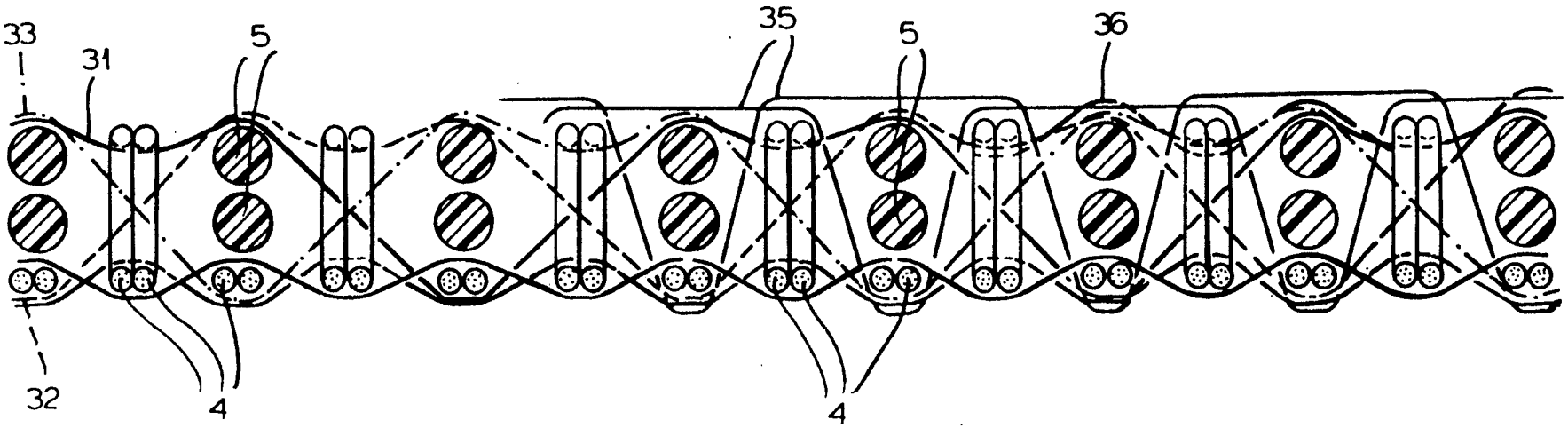
FIG. 4 is a view similar to FIG. 3 but illustrating another binding pattern according to the invention.

As a comparison of FIGS. 1 and 3 or 1 and 4 will show, a first binding warp group or arrangement with a plurality of binding warp yarns 31, 32, 33 or 31, 32, 33, 34 is provided so that these binding warp yarns always pass under the double wefts 4, pass over at least two coupling members and pass under a coupling member 5 and the double weft 4 thereunder.

In addition, the system comprises a second binding warp yarn arrangement or group having at least one binding warp yarn 35 so arranged that it passes over the double wefts 4 between the coupling members 5 and below the coupling members 5 and the double wefts 4 underlying same. One of the binding warp yarns of the first group and a binding warp yarn of the second group together underlie a coupling element and the double weft yarn underlying same. Of especial importance to the invention is the binding warp yarn insertion or incorporation ratio. This is defined as the ratio of the length of the binding warp yarn, before it is bound in place, to the length of the slide fastener chain from which the slide fastener is fabricated and comprised of the tape 1 and the row 2 of coupling elements. The binding warp yarn insertion proportion or ratio is apparent from the drawing and for the binding warp yarns 31–33 or 31–34 of the first group is 1.25:1 to 1.35:1. The at least one binding warp yarn 35 of the second group has an insertion ratio of 2.50:1 to 3.50:1.

The system can include a third arrangement of binding warp yarns represented by at least one binding warp yarn 36 which draws the ground wefts 4 between the coupling members 5 into the aforementioned loop and thus passes under these double wefts, but also over the coupling members.

The first and second binding warp yarn arrangement or groups can be close to the rear of the coupling coil, i.e. proximal to the connecting parts 8 while the third binding warp unit arrangement can lie close to the heads 6. The binding warp yarn insertion ratio for this third group or arrangement is in the range of 1.10 to 1.20.

In the embodiment illustrated in FIG. 4, the first binding warp yarn arrangement is comprised of three binding warp yarns 31, 32, 33 which are offset from one another by two weft insertions.

In the embodiment of FIG. 3, the first binding warp yarn arrangement is comprised of four binding warp yarns 31, 32, 33, 34 which are offset by two weft insertions.

In the embodiment of FIG. 4, two binding warp yarns 35 of the second arrangement are offset by two weft insertions from one another and pass in the pattern of high/high/low/high. For the third binding warp yarn arrangement, the pattern is high/low. The pattern of high/high/low/high is also possible.

The binding warp units 33–36 of the first and/or second and/or third binding warp yarn arrangements can lie on the shank 5 in groups adjacent one another.

Figure 5:
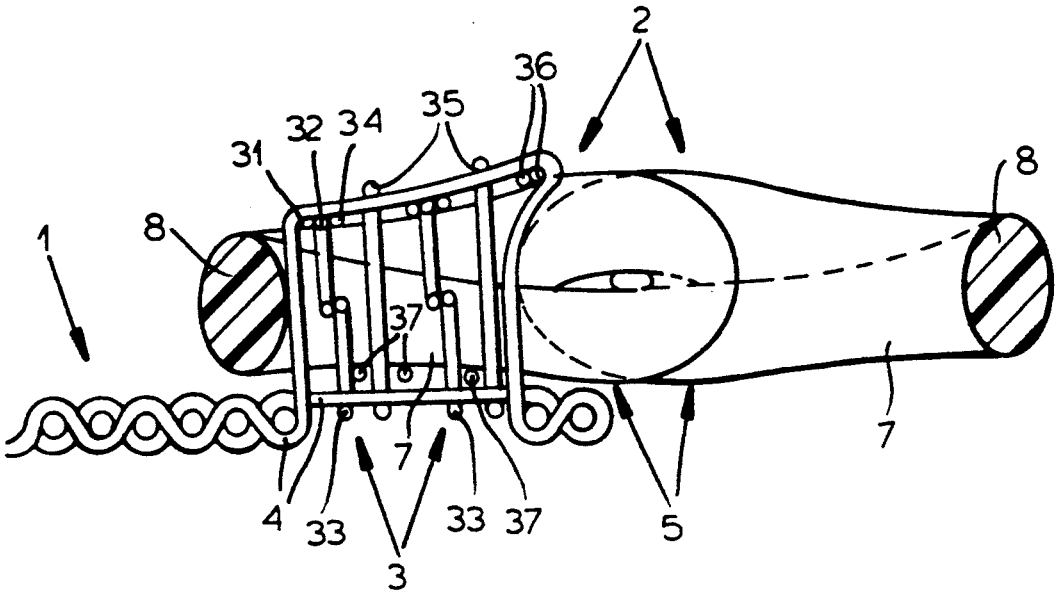
FIGS. 5 and 6 are views similar to FIG. 2 illustrating other embodiments of the invention.
Figure 6:
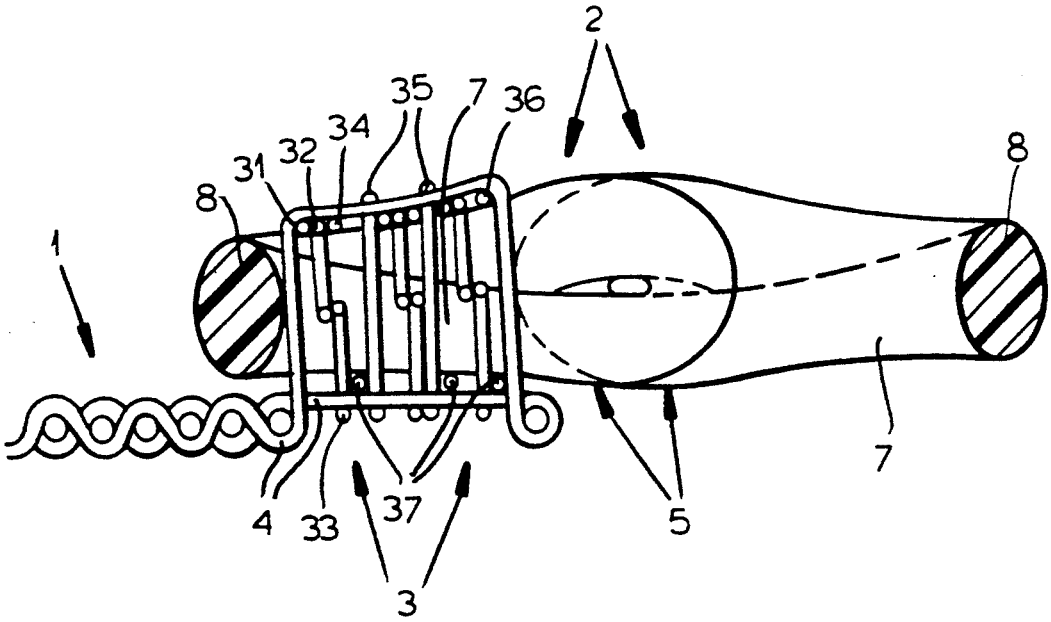

From FIGS. 3, 5 and 6 it will be apparent that additional stay yarn 37 can be formed of binding warp yarns passing between the coupling elements 5 and the double wefts 4. FIG. 6 also shows that the binding warp yarn arrangements can be varied in number and position.

I claim:

1. A woven-tape slide-fastener half with a plastic monofilament coupling row woven therein, comprising:

a woven tape having a multiplicity of double wefts interwoven with warps, the double wefts being formed by a continuous weft yarn defining in the tape a ground weft; and a continuous plastic monofilament coupling row woven into said tape along a longitudinal edge thereof, said coupling row being comprised of coupling elements having:

spaced apart coupling heads formed by bends of the plastic monofilament, a pair of shanks extending rearwardly from each of said heads as a monofilament double weft so that projections of each shank on a plane of the tape are substantially superimposed, and respective connecting bights along a rear of the row connecting each of said shanks to a shank of an adjoining coupling element, each of said pair of shanks overlying a double weft of said ground weft, a further double weft of said ground weft being disposed between pairs of shanks of successive coupling elements without passing over said row, the warps in a region of said row including a plurality of binding warp yarns passing in part over said elements, the further double wefts being drawn up from said plane to a region of an upper shank of the respective pair by at least one of said binding warp yarns to form a bracing loop of said weft yarn between the pairs of shanks of said coupling elements, said binding warp yarns including a first group comprised of a plurality of said binding warp yarns so interwoven in said tape as always to pass under double wefts of the ground weft, over at least two coupling elements of the row and then under a pair of shanks and the double weft of the ground weft underlying same, said binding warp yarns including a second group comprised of at least one binding warp yarn in succession, passing over the double wefts of the ground weft between the coupling elements, and under a pair of shanks and the double weft of the ground weft underlying same, and each pair of shanks and an underlying double weft of the ground weft beneath which a binding warp yarn of the first group passes also being underpassed by a binding warp yarn of the second group, the binding warp yarn of the first group having a pattern of high/low/-high/low/low/low or high/low/high/low/-low/low/high/low in passing over two or three coupling elements, the binding warp yarns of the first group having a binding warp yarn insertion ratio of substantially 1.25:1 to 1.35:1, and at least one binding warp yarn of said second group having a binding warp yarn insertion ratio of 2.50:1 to 3:50:1.

2. The woven-tape slide-fastener half defined in claim 1 wherein a plurality of the binding warp yarns of at least one of the groups lie on the shanks of the coupling members adjacent one another.

3. The woven-tape slide-fastener half defined in claim 1 wherein said binding warp yarns include stay threads extending between the ground weft double wefts underlying said coupling elements and the shanks of the coupling elements.

4. The woven-tape slide-fastener half defined in claim 1 wherein the weft and warp yarns are composed of polyester threads and the monofilament is composed of a material selected from the group which consists of polyamide and the polyesterbutyleneterephthalate.

5. The woven-tape slide-fastener half defined in claim 4 wherein said monofilament is composed of nylon 6,6.

* * * * *